US005819935A

United States Patent [19]

Lawson

[11] Patent Number: 5,819,935

[45] Date of Patent: Oct. 13, 1998

[54] DISPENSER FOR A ROLL OF SHEET MATERIAL

[76] Inventor: Richard A. Lawson, 3013 Mulberry Cir., Thousand Oaks, Calif. 91360

[21] Appl. No.: 55,341

[22] Filed: Apr. 6, 1998

[51] Int. Cl.[6] ..... B65D 85/671

[52] U.S. Cl. ..... 206/408; 206/409

[58] Field of Search ..... 206/389, 397, 206/408, 409, 411

[56] References Cited

U.S. PATENT DOCUMENTS 5,509,561 4/1996 Kanterovitch ..... 206/409

5,593,035 1/1997 Taylor et al. ..... 206/409

*Primary Examiner*—Jacob K. Ackun

*Attorney, Agent, or Firm*—Jack C. Munro

[57] ABSTRACT

A dispenser for a roll of sheet material which comprises a sheet material housing within which is rotatably supported the roll of sheet material. The housing can be in the shape of a box composed of a base and a lid which are hingedly connected together or can be in the shape if a cylindrical tube with access to within the housing being provided by a removable end cap. Each housing includes a longitudinal slot through which the free end of the roll of sheet material is to be conducted and located exteriorly of the housing. Mounted on the exterior surface of each housing directly adjacent each slot is a cutting shelf which is substantially the same length as the slot. The unwound sheet material is to rest on the shelf and provide a cutting surface for severing of the unwound section of sheet material from the roll.

6 Claims, 3 Drawing Sheets

DISPENSER FOR A ROLL OF SHEET MATERIAL

BACKGROUND OF THE INVENTION

1. Field of the Invention

The field of this invention relates to dispensers, and more particularly to a dispenser for a roll of sheet material.

2. Description of the Prior Art

Rolls of sheet material come in substantially different sizes and shapes for numerous different types of sheet material. A typical sheet material can be paper, plastic or metal foil. The rolls of sheet material can be small in size weighing only a few ounces or can be several feet in length weighing in excess of fifty pounds. Rolls of sheet material could actually be larger in size and substantially heavier in weight. However, the subject matter of this invention is not intended for those exceedingly heavy rolls such as are commonly used in the manufacturing of paper products.

Sheet material plastic is commonly used in the construction industry. This plastic is made into a roll with the roll being about thirty-nine inches in length. The actual width of the plastic is about twelve feet with the plastic being overlapped when it is in the roll form. This plastic is used by painters to protect furniture and carpets from splatter when painting. This plastic is also used as a moisture barrier within walls of houses and buildings. The typical weight of such a roll of plastic is between thirty and fifty pounds.

At the present time, there is no known dispenser for such a roll of plastic. The common way that the plastic is dispensed is for an estimated desired length of the plastic to be unwound from the roll and then that length being severed generally by the utilizing of a pair of scissors. Because plastic is so flimsy, it is not easily cut. Therefore, the cutting of the plastic is not even. If it is desired to cut the plastic to a certain specified length, such is nearly impossible because accuracy in cutting of the plastic is not achievable.

The typical dispensing procedure for a roll of plastic is to have one person pick up and hold the roll while another person unwinds the plastic and then sever the plastic by a pair of scissors when the approximate length has been obtained. In essence, the dispensing of the plastic is a two-man operation which is therefore inherently expensive because of the double manpower required. There is a need to construct a dispenser for a roll of plastic wherein the plastic can be dispensed in reasonably accurate lengths and also where the dispensing procedure can be accomplished by a single individual rather than two individuals.

SUMMARY OF THE INVENTION

One of the primary objectives of the present invention is to provide a dispenser for a three to four foot length of sheet material which is located in the form of a roll with this roll weighing in excess of twenty pounds.

Another objective of the present invention is to construct a dispenser for a roll of sheet material which makes the dispensing of the sheet material a one person operation where previously it had been a two person operation.

The dispenser of the present invention can be constructed in two embodiments, the first embodiment being in the form of a box having a lid which is pivotly mounted to a base, and a second form comprising a cylindrical tube with access into the cylindrical tube being provided through an end of the tube which is normally covered by an end cap. Within both housings, the roll of sheet material that is to be dispensed is mounted in a manner permitting rotation of the roll so that the free end of the roll can be conducted through a longitudinal slot formed in the housing. Mounted on the exterior surface of the housing directly adjacent the longitudinal slot is a cutting shelf. When the desired length of sheet material has been dispensed, a separate cutting device is pressed against the cutting shelf and moved longitudinally along the shelf which will result in severing of the sheet material. The severed section of sheet material is then used in the desired manner.

DETAILED DESCRIPTION OF THE PREFERRED EMBODIMENTS

Figure 1:
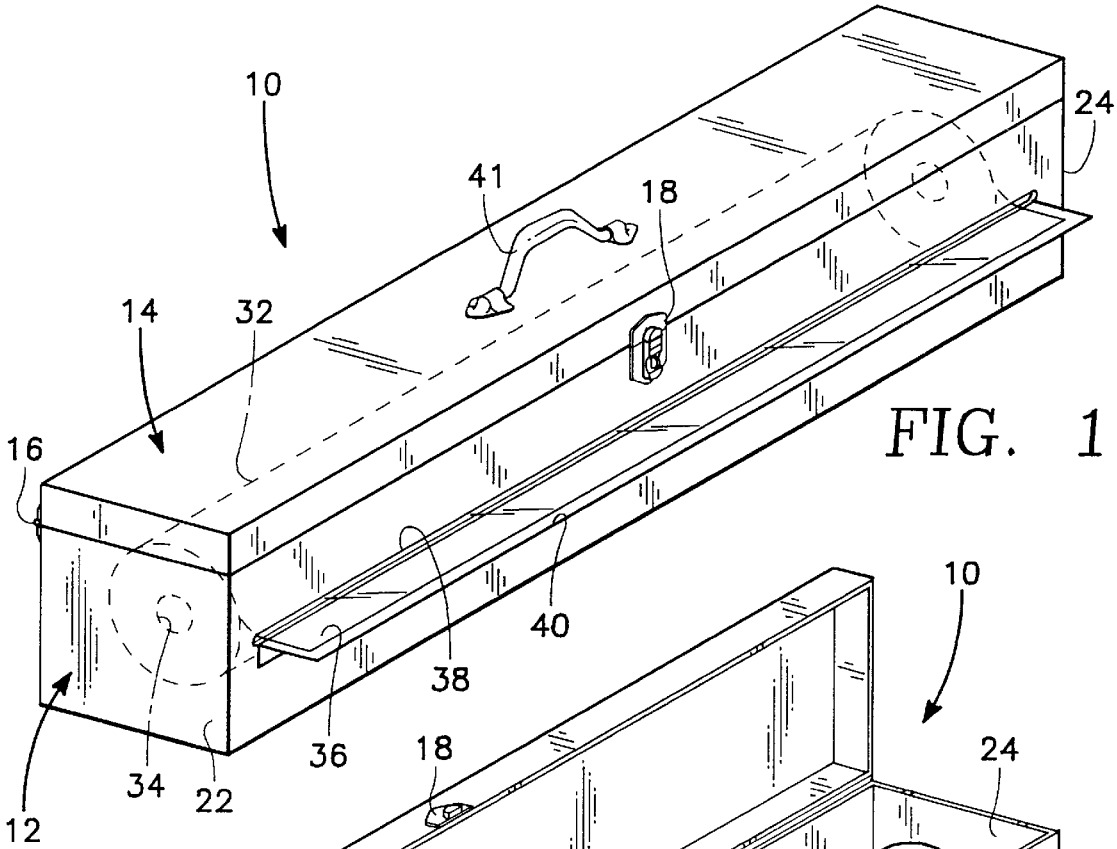
FIG. 1 is an exterior isometric view of the first embodiment of the dispenser of the present invention showing the dispenser in the closed position.
Figure 2:
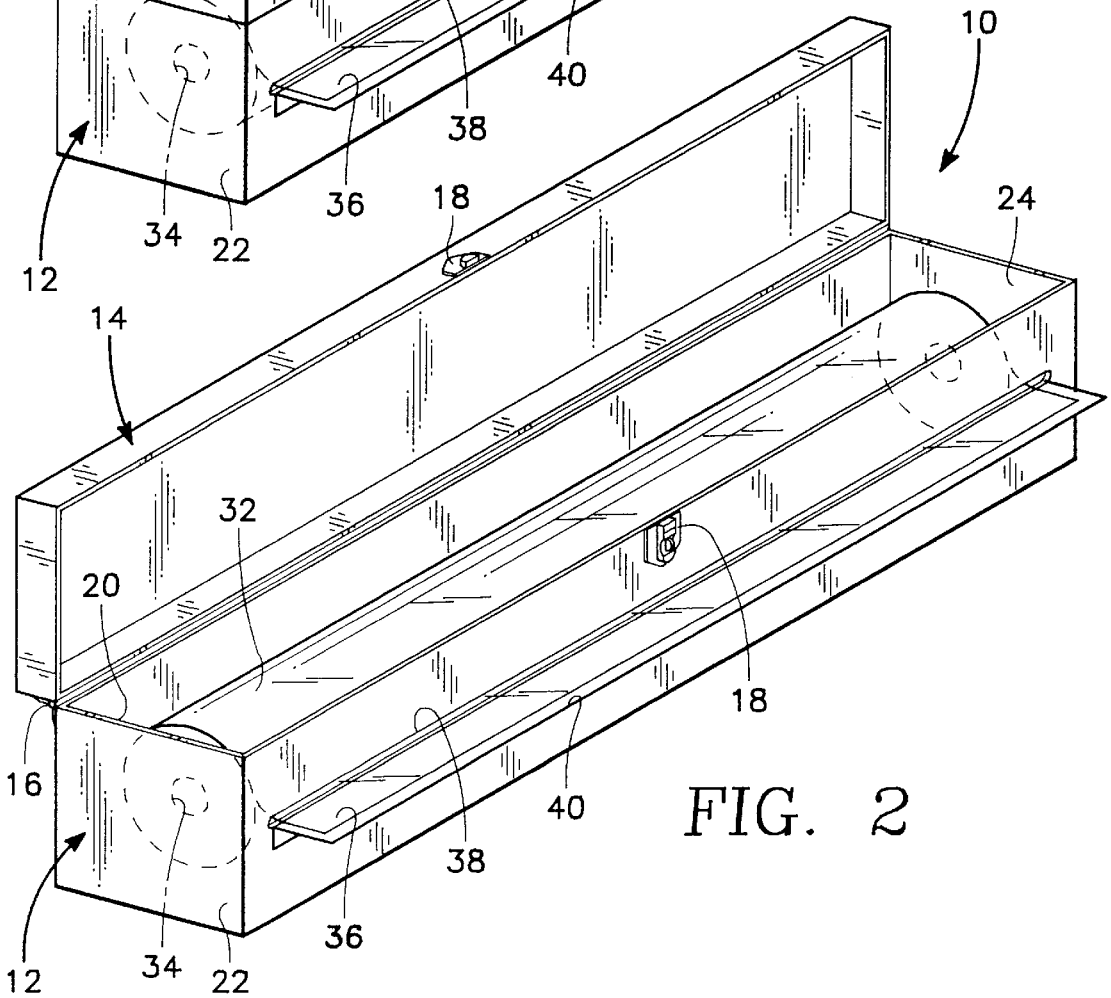
FIG. 2 is an exterior isometric view of the first embodiment of the dispenser of the present invention showing the dispenser in the open position.
Figure 3:
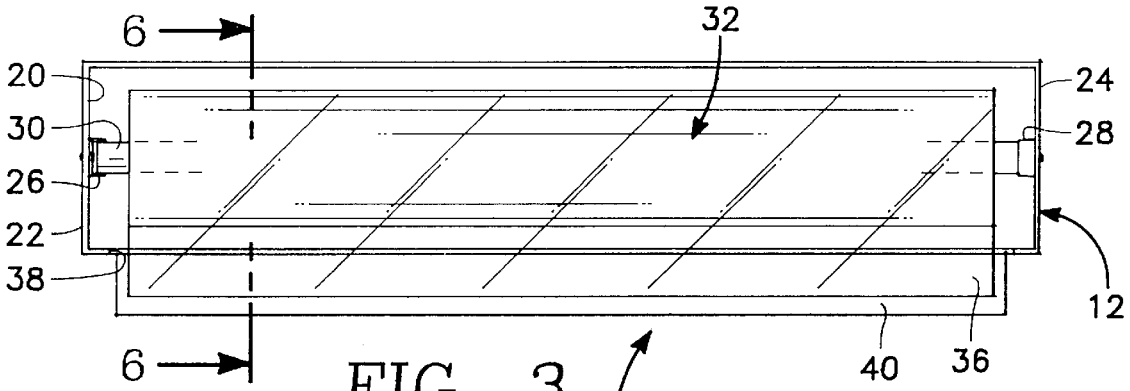
FIG. 3 is a top plan view of the base of the dispenser of the present invention with the top being removed which is, in essence, the open position of FIG. 2.
Figure 4:
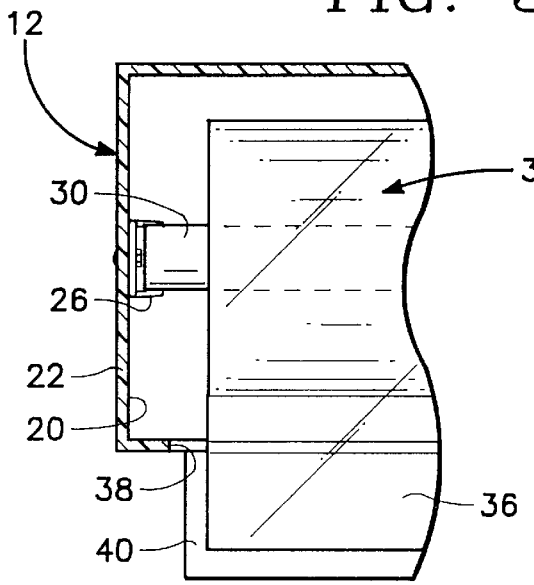
FIG. 4 is an enlarged view of the left end of the first embodiment of dispenser of FIG. 3.
Figure 5:
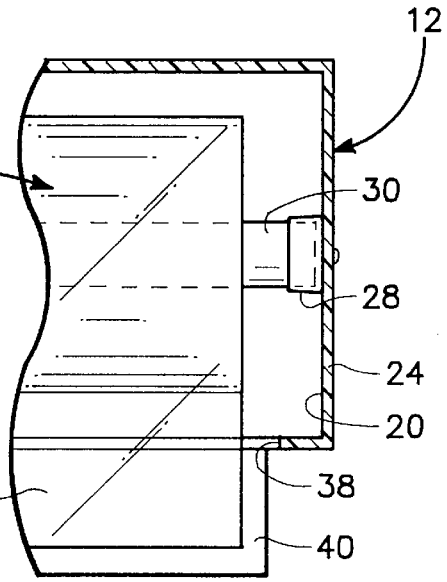
FIG. 5 is an enlarged view of the right end of dispenser of FIG. 3.
Figure 6:
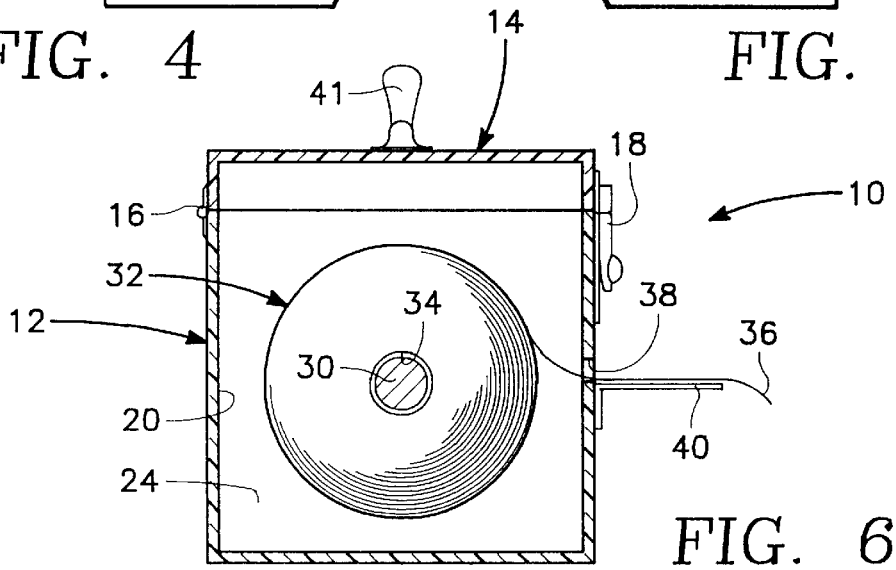
FIG. 6 is a cross-sectional view taken along line 6—6 of FIG. 3.

Referring particularly to the drawings, there is shown the first embodiment of dispenser 10 of this invention. The first embodiment 10 is shown to be in the form of a box which in transverse cross-section is rectangular or square and also rectangular or square in longitudinal cross-section. The first embodiment 10 is constructed of a housing which is comprised of a base 12 and a top 14. The rear edge of the top 14 includes a hinge 16. The hinge 16 is connected between the upper end of the base 12 and the top 14 with the result that the top 14 is capable of a pivoting opening movement from the closed position shown in FIG. 1 to the open position shown in FIG. 2. When in the closed position shown in FIG. 1, a latch 18 is to be connected which securedly locks the top 14 to the base 12 and maintains the position of the dispenser 10 in the closed configuration as shown in FIG. 1.

The top 14 and base 12 cooperate together to form an internal chamber 20. Internal chamber 20 terminates in a left end wall 22 and a right end wall 24. Centrally mounted on the left end wall 22 within the internal chamber 20 is a rod support 26. A similar rod support 28 is centrally mounted on the interior surface of the right end wall 24. It is to be noted that the rod support 26 is in the form of a half circle where the rod support 28 is in the form of a complete circle. The reason for this is that between the rod supports 26 and 28 there is to be mounted a support rod 30. The support rod 30 is to be removable from the rod supports 26 and 28 with this removability being permitted by the half circle construction of the rod support 26 which permits the support rod 30 to be lifted from the rod support 26 and then removed from the internal compartment 20.

A roll 32 of sheet material has a longitudinal through hole 34. The through hole 34 is centrally disposed relative to the roll 32. Sheet material is to be wound about the through hole 34 with the sheet material having a free outer end 36.

There is formed a longitudinal slot 38 within the base 12. The length of the slot 38 is substantially equal to the length of the sheet material on the roll 32. Actually in the drawing, the slot is shown slightly larger, but in reality, the lengths are substantially equal. The free outer end 36 is to be threaded through the slot 38, and according to the desires of the user, the length of sheet material is preselected with that length of sheet material to be measured from the base 12. Mounted on the base 12 directly beneath the slot 38 is a cutting shelf 40. This shelf 40 is planer and is normally formed of a rigid sheet material with usually metal being preferred. The free outer end 36 merely rests on the shelf 40. A cutting implement, such as a knife, is to then be used by longitudinally moving of the cutting implement against the shelf 40 along its total longitudinal length which in turn will result in severing of the free outer end 36. In order to effectively cut the sheet material plastic free outer end 36, a separate cutting implement must be used with it being discovered that a saw tooth edge will not cut the plastic because the plastic is too flimsy and it stretches. In this manner, the desired length of sheet material to be used is then obtained. In order to facilitate portability of the first embodiment 10, there is mounted on the top 14 a handle 41. By grasping of the handle 41, the user can move the first embodiment 10 from one location to another.

Figure 7:
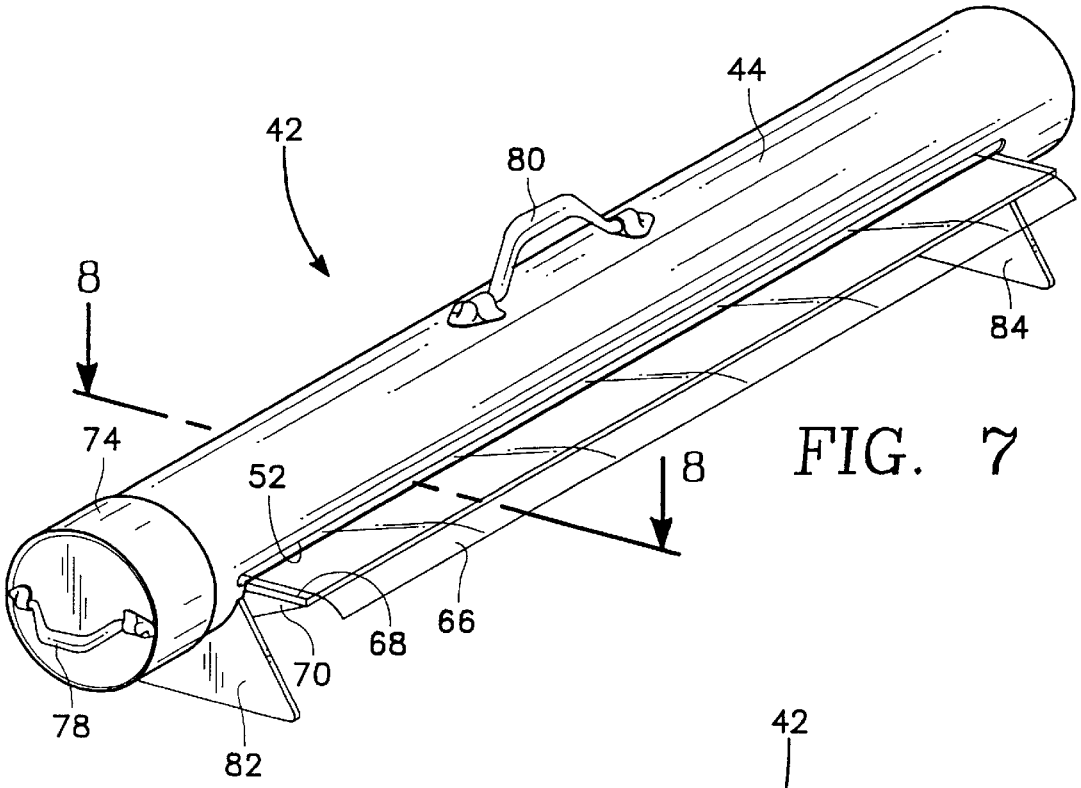
FIG. 7 is an exterior isometric view of a second embodiment of dispenser of the present invention.
Figure 8:
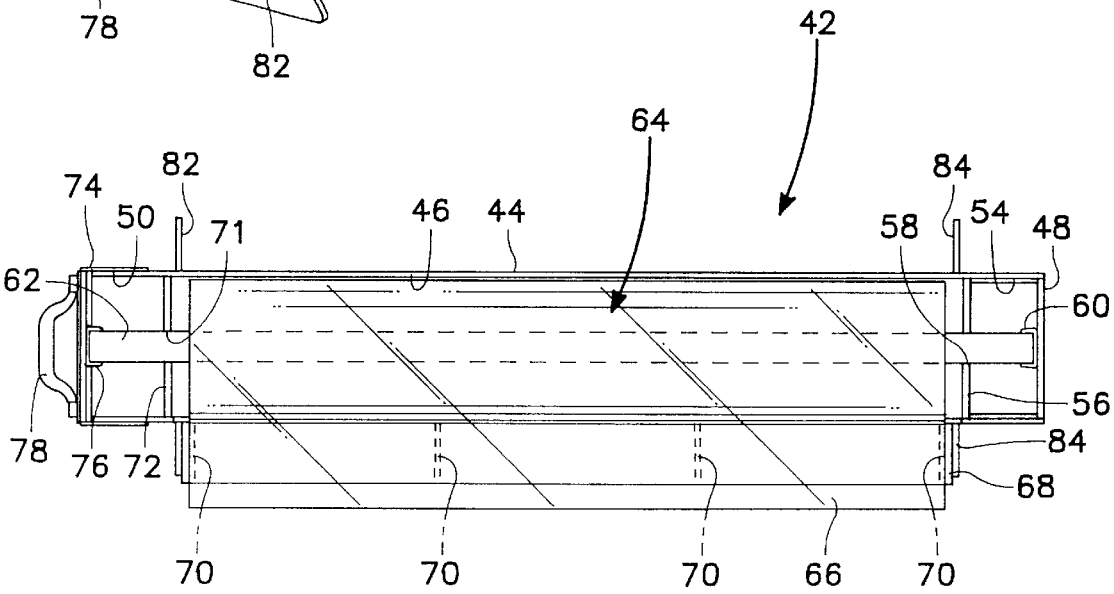
FIG. 8 is a longitudinal cross-sectional view of the second embodiment of dispenser of the present invention taken along line 8—8 of FIG. 7.

Referring particularly to FIGS. 7 and 8 of the drawings, there is shown the second embodiment 42 of this invention. The second embodiment 42 has a cylindrical housing 44 which has an internal chamber 46. The cylindrical housing 44 has a closed end 48 and is open at the opposite end forming an access opening 50. Formed within the housing 44 is a longitudinal slot 52. It is to be noted that the length of the slot 52 terminates at each end some spaced distance from the closed end 48 and some spaced distance from the access opening 50. It is necessary that, for purposes of structural strength, the spacing be permitted.

Within the internal chamber 46 there is placed a spacer member such as a short tube 54 with this tube 54 being placed directly against the closed end 48. Snugly located within the internal chamber 46 is a disc 56 with this disc 56 to be placed against the short tube 54. The disc 56 includes a center hole 58. Mounted on the inside surface of the closed end 48 is a rod support bracket 60 which is essentially identical to the rod support bracket 28. The rod support bracket 60 is centrally disposed on the closed end 48.

A support rod 62 is to be located within the internal chamber 46 with the support rod 62 passing through the center hole 58 and being fixed in position by being placed within the rod support bracket 60. On the support rod 60 there is mounted the roll 64 of sheet material which is essentially identical to the roll 32. The roll 64 of sheet material has a free outer end 66 which is conducted through the slot 52. Again, the length of the slot 52 is to be essentially identical to the length of the sheet material of the free outer end 66. The free outer end 66 is to rest on a cutting shelf 68 with this cutting shelf 68 being fixedly mounted to the cylindrical housing 44 by means of a plurality of spaced-apart braces 70. The cutting shelf 68 is again planer and will generally be formed of metal. Once the desired amount of sheet material has been dispensed from the roll 64, the cutting implement, which is again not shown, is to be moved longitudinally along the cutting shelf 68 to effect severing of the free outer end 66 from the roll 64.

Snugly mounted on the support rod 62 is a disc 72. Disc 12 has a center hole 71 through which is conducted support rod 62. The disc 72 functions as a stop to prevent movement of the roll 64 in the direction toward the access opening 50. The position of disc 72 can be adjusted on support rod 62 so disc 72 abutts against the roll 64. The access opening 50 is to be closable by means of an end cap 74 with this end cap 74 being snugly installed on the housing 44. Internally mounted within the end cap 74 is a rod support bracket 76. The outer end of the support rod 62 is to be mounted within the rod support bracket 76.

In order to facilitate removal of the end cap 74, there is mounted a handle 78 on the end cap 74. The installation procedure for the roll 64 is to remove the end cap 74 and tilt the cylindrical housing 44 in a vertical manner and then slide the roll 64 onto the support rod 62 which has already been installed within the internal chamber 46. The roll 64 will then slide down and slam into the disc 56. However, disc 56 is not capable of being moved by means of the location of the short tube 54 which is located between the disc 56 and the closed end 48. The end cap 74 is then installed in position as shown in FIG. 8 of the drawings.

In order to facilitate portability of the cylindrical housing 44, there is mounted a handle 80 on the exterior surface of the cylindrical housing 44. Also, the cylindrical housing 44 includes a pair of support feet 82 and 84 which are to facilitate fixedly positioning of the cylindrical housing 44 onto a planer supporting surface which is not shown.

What is claimed is:

1. A dispenser for a roll of sheet material comprising:

a housing having an internal wall, said housing having an internal chamber confined by said internal wall, said internal chamber adapted to receive a roll of sheet material;

a support rod upon which is adapted to rotatably support the roll of sheet material, said roll having a free end of sheet material which is to be unwound from said roll;

rod support means mounted to said housing and located within said internal chamber said support rod to be longitudinally centrally mounted by said support rod means which rotationally mounts said roll within said housing;

a longitudinal slot formed in said housing, said free end of said roll to protrude exteriorly of said housing through said slot;

a cutting shelf mounted on said housing, said cutting shelf being located directly adjacent said slot, said cutting shelf being approximately the same length as said slot, said cutting shelf being planer; and whereby said free end is to be grasped and pulled causing unwinding of said sheet material from said roll, and upon a desired length of said sheet material being obtained, a separate cutting device is to be used to sever said sheet material by a cutting action direction against said cutting shelf upon which is located said sheet material.

2. The dispenser as defined in claim 1 wherein:

said housing being polygonal shaped, said housing being formed of a base and a lid with said lid being pivotly attached to said base, a handle being mounted on said lid, said lid being pivotly movable relative to said base between an open position providing access into said internal chamber and a closed position preventing access into said internal chamber.

3. The dispenser as defined in claim 1 wherein:

said housing being cylindrical, said housing having an open end through which is to be conducted said roll of sheet material, said open end to be closable by an end cap.

4. The dispenser as defined in claim 3 wherein:

said end cap including a first handle, said housing including a second handle, said first handle to facilitate the manual extraction of said end cap from said housing and the manual replacement of said end cap on said housing, said second handle facilitating portability of said housing by said housing being carried.

5. The dispenser as defined in claim 3 wherein:

said housing having mounted thereon supporting feet, said supporting feet being adapted to come into contact with a supporting surface.

6. The dispenser as defined in claim 3 wherein:

said housing having a closed end, a spacer member mounted in said internal chamber and located at said closed end, a disc abutting against said spacer member, said roll to abut against said roll of sheet material.

* * * * *